United States Patent [19]

Narang et al.

[11] 4,066,109

[45] Jan. 3, 1978

[54] PENCIL SHARPENER WITH REPLACEABLE BLADES

[76] Inventors: Rajendra K. Narang; Manish Narang; Ashish Narang, all of 1525 Bonnie Road, Macedonia, Ohio, 44056.

[21] Appl. No.: 713,694

[22] Filed: Aug. 12, 1976

[51] Int. Cl.[2] ..... B43L 23/08

[52] U.S. Cl. ..... 144/28.11; 145/3.5

[58] Field of Search ..... 145/3.5, 3.3, 3.4; 144/28.11

[56] References Cited

U.S. PATENT DOCUMENTS

| | | | |
|---|---|---|---|
| 1,719,714 | 7/1929 | Miller | 145/355 |
| 2,039,687 | 5/1936 | Ficker et al. | 145/3.5 |

FOREIGN PATENT DOCUMENTS

| | | | |
|---|---|---|---|
| 467,798 | 9/1950 | Canada | 145/3.5 |
| 828,658 | 1/1952 | Germany | 145/3.5 |

*Primary Examiner*—Donald R. Schran

*Attorney, Agent, or Firm*—Donnelly, Maky, Renner & Otto

[57] ABSTRACT

A hand-held pencil sharpener is disclosed which utilizes a common double-edged safety razor blade that may be easily removed and replaced when worn. The pencil sharpener has spaced, generally parallel tapered bores of varying sizes selectively to guide pencils of different diameters against the shaving edges of the razor blade as the pencil is rotated, said razor blade being positioned between said parallel bores tangentially to place the opposed sharpened edges thereof into the bores to form the shaving edges of the sharpener.

8 Claims, 6 Drawing Figures

PENCIL SHARPENER WITH REPLACEABLE BLADES

BACKGROUND OF THE INVENTION

This invention relates to a hand-held pencil sharpener which incorporates a double-edged razor blade to form the sharpening or shaving edges thereof, said razor blade being readily removable when worn for easy replacement.

There are a number of hand-held pencil sharpeners marketed in different sizes, shapes, colors and styles. Generally, the sharpeners are made out of hard plastic or bakelite. They contan one or more tapered bores which guide a pencil as it is rotated against a cutting edge which is positioned lengthwise of the hole. Upon rotation of the pencil, the cutting edge is operative to shave pieces of wood and lead off the end of the pencil to sharpen the same.

The cutting edge of the sharpener is generally a relatively thick flat blade of poor quality sharpened on only one side. Said blade is normally riveted to the sharpener although occasionally the blades may be secured by screws or the like. In the course of use, the blade or blades may rust and/or become dull in a relatively short period of time. When the blade is thus worn, the sharpener produces a poor sharpening action. Often, the lead of the pencil being sharpened is broken several times during the sharpening process reducing the useful life of the pencil. This blade wear necessitates frequent replacement of the blade or possibly of the entire sharpener.

Some sharpeners on the market have several holes, usually of different sizes, for sharpening differently sized pencils. For each such hole, there is a separate blade which may become worn, thereby multiplying the above enumerated problems by the number of holes.

SUMMARY OF THE INVENTION

In the instant invention, a readily available double-edged safety razor is used to provide a high quality cutting edge or edges for a hand-held pencil sharpener. Such razor blade can be easily removed and replaced when worn, thereby greatly to increase the useful life of such sharpener.

The razor blade is positioned so that its opposite edges run lengthwise along tapered, generally parallel bores in the sharpener to provide the shaving action for the pencils inserted in such bores. The sharpener can have up to four holes of different sizes, two holes sharing each edge of the blade. The sharpener may also have one hole which extends substantially the entire length of one side of the blade in order to accommodate larger diameter pencils, as well as pencils of a smaller diameter.

It is accordingly the principal object of the present invention to provide a hand-held sharpener having a razor blade therein to define the shaving edges. Such razor blades are readily available and are generally provided with high wuality cutting edges formed from specially treated and protectively coated stainless steels.

It is another object of the present invention to provide structure easily permitting the removal of a worn razor blade for replacement by a new blade. This greatly increases the effective life of the sharpener by the use of a new blade that is readily available from a domestic or commercial supply.

It is yet another object of the present invention to provide as many as four effective cutting or shaving edges from one double-edged razor blade so that it may accommodate up to four differently sized pencils. This increases the versatility and utility of the sharpener. In addition, if not all the cutting surfaces are utilized, the blade may from time to time be changed from one side or face to another to present a sharp edge without the necessity for replacing the blade.

Other objects and advantages of the present invention will become apparent as the following description proceeds.

To the accomplishment of the foregoing and related ends the invention, then, comprises the features hereinafter fully described and particularly pointed out in the claims, the following description and the annexed drawing setting forth in detail certain illustrative embodiments of the invention, these being indicative, however, of but a few of the various ways in which the principle of the invention may be employed.

DESCRIPTION OF THE PREFERRED EMBODIMENT

Figure 1:
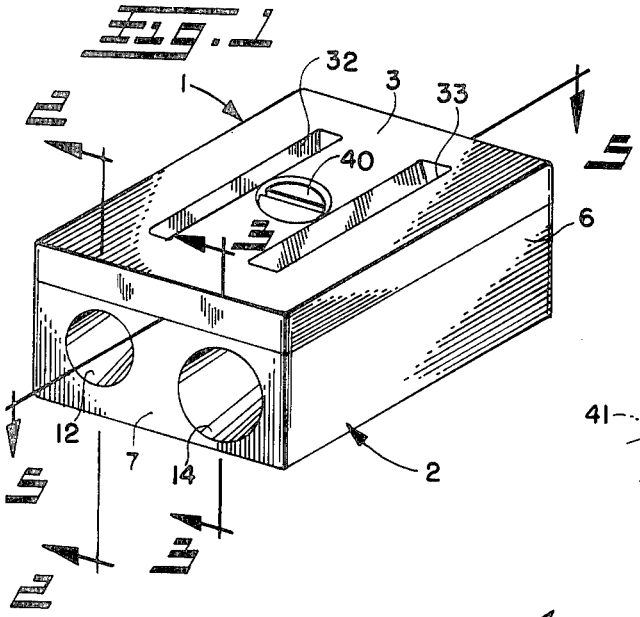
FIG. 1 is a perspective view of the hand-held pencil sharpener.

Referring now to the drawing and initially to FIG. 1, the hand-held pencil sharpener of the present invention is generally indicated at 1 and includes a housing 2 and cover 3. The housing 2 is provided with tapered bores of varying sizes selectively to receive and guide pencils of varying sizes for sharpening.

Figure 2:
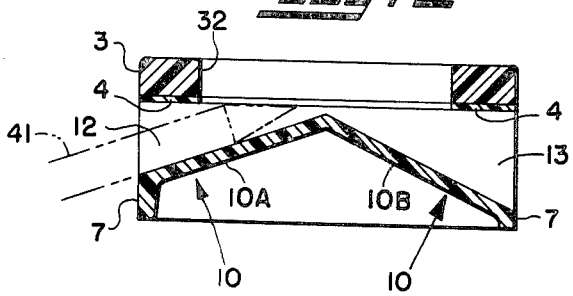
FIG. 2 is a vertical section taken along the plane 2—2 in FIG. 1 showing in phantom a pencil inserted for sharpening.
Figure 5:
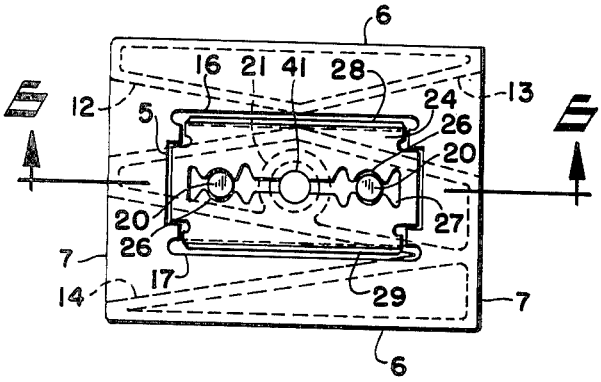
FIG. 5 is a plan view along line 5!3 5 in FIG. 1 showing the sharpener housing with the cover therefor removed.
Figure 6:
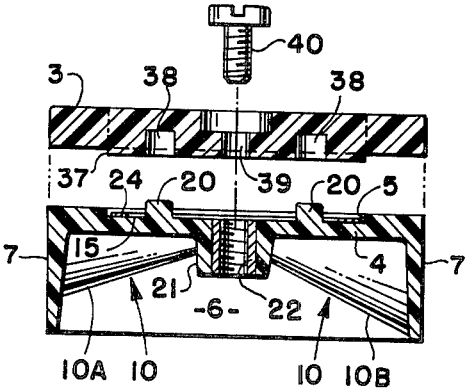
FIG. 6 is an exploded vertical side section including the cover and fastener, taken generally along line 6—6 in FIG. 5.

The housing 2 has a top wall 4 with recess 5, sidewalls 6 and end walls 7. The tapered bores to receive the pencils are defined by generally conically shaped bottom walls 10 cooperating with and preferably integrally formed with the top wall 4 and end walls 7. The bottom walls 10 can be of different sizes to form a plurality of variously sized tapered bores selectively to accommodate pencils of different sizes. As best shown in FIGS. 2 and 5, one side of housing 2 is provided with a first tapered bore 12 formed by bottom wall 10A in conjunction with top wall 4 and end wall 7. In axial alignment therewith, a second oppositely facing tapered bore 13 is defined by bottom wall 10B in conjunction with top wall 4 and the other end wall 7, said second bore 13 being slightly larger in diametrical extent than the first bore 12 to receive pencils of correspondingly larger diameter.

Figure 3:
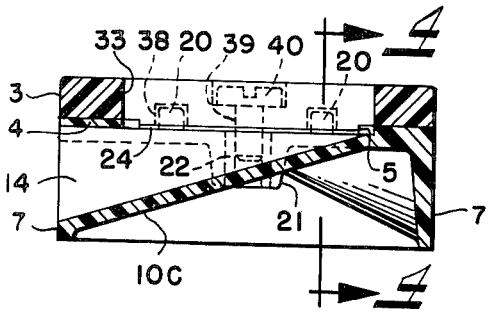
FIG. 3 is a vertical side section, taken along the plane 3—3 in FIG. 1.

As best shown in FIGS. 3 and 5, the other side of housing 2 is provided with a third tapered bore 14 defined by bottom wall 10C in conjunction with top wall 4 and an end wall 7, said third bore 14 extending substantially from end to end of housing 2. The third bore is generally parallel to and laterally spaced from the first and second bores 12 and 13, respectively. Although three bores have been illustrated and described, the present invention contemplates the use of any number and/or combinations of bores in the housing to cooperate with the razor blade in the manner described hereinafter or in the equivalent thereof.

Figure 4:
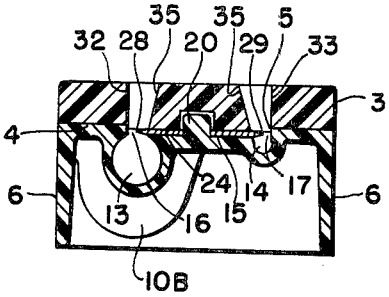
FIG. 4 is a vertical end section, taken along the plane 4—4 in FIG. 3.

As best shown in FIGS. 4 and 5, the bores 12 and 13 substantially tangentially intersect the horizontal surface 15 of recess 5 along an inner portion of their respective lengths, thereby to form an elongated slot 16 in surface 15. Similarly, bore 14 tangentially intersects horizontal surface 15 of recess 5 along an inner portion of its longitudinal extent to define a second elongated slot 17 parallel to and laterally spaced from the first slot 16.

As best shown in FIG. 5, the ends of the recess 5 are generally configured to be of the same shape as the ends of a double-edged razor blade. Such recess 5 has two axially aligned and longitudinally spaced upstanding locating studs 20 and a centrally positioned, downwardly extending boss 21 with an internally threaded bore 22 therethrough.

A razor blade 24 may be positioned in the recess 5 by lowering and orienting the same so that the upwardly projecting locating studs 20 are snugly respectively received in and pass through the spaced generally circularly formed sections 26 in the razor blade slot 27. The locating studs 20 thus preclude rotational movement for the razor blade 24 and positively position the same in operative relationship. In this latter regard, when the razor blade is thus positioned in recess 5, the opposed cutting edges 28 and 29 are respectively located in the slots 16 and 17. In such position, the cutting edge 28 tangentially extends into the first bore 12 and second bore 13 to define the pencil shaving edges for the same. The other cutting edge 29 of razor blade 24 tangentially extends into the third bore 14 to define the pencil shaving edge therein.

The razor blade 24 is enclosed by the cover 3 superimposed thereon. As shown, the cover 3 is substantially coextensive with the housing 2 and includes two laterally spaced parallel slots 32, 33. Such slots are substantially coextensive with the slots 16 and 17 and are equally laterally spaced to be in vertical alignment with such slots when the cover 3 is positioned on housing 2. The slots 32, 33 may be of any cross sectional configuration, although inwardly tapered inner walls, as shown at 35, are preferred to provide increased space for pencil shaving removal and for improved observation.

The bottom wall of cover 3 is provided with a downwardly extending projection 37 that is shaped to be relatively tightly received in the recess 5 to entrap the razor blade 24. Two axially aligned and longitudinally spaced cylindrical sockets 38 are provided in projection 37 of cover 3, such sockets 38 receiving locating studs 20 to preclude cover rotation. The cover 3 is provided with a countersunk hole 39 that receives a screw 40, the shank of which extends through the central hole 41 in the razor blade slot 27 and threadingly mates with the threaded bore 22 in boss 21 on housing 2. Such screw 40 thus positively secures the housing 2, razor blade 24 and cover 3 together to prevent relative rotation therebetween. Although the cover is shown as one piece and coextensive with housing 2, such housing may be made from more than one piece with any configuration as long as a structure is provided to enclose and hold the razor blade and to permit pencil shaving removal in the manner described or its equivalent.

In operation, a razor blade 24 is accurately located by studs 20 in recess 5 and the cover 3 is then superimposed upon the housing and secured thereto by screw 40, as shown in FIG. 1. The countersunk hole 39 receives the head of the screw 40 to provide a flush appearance. A pencil 41 may then be selectively inserted into any of the bores 12–14 according to the size of the pencil, as shown, for example, by the phantom lines in FIG. 2. When so inserted, the pencil 41 is rotated to bring the end thereof into shaving contact with the tangentially exposed cutting edge of the razor blade. This rotation causes removal of the pencil wood and lead and results in such pencil assuming the shape of the bore to provide a sharp point for the lead at the end thereof. The shavings removed exit through the aligned slots 16 and 32 or 17 and 33 respectively. If desired, a receptacle (not shown) may be releasably secured to the cover 3 to collect the shavings passing through such aligned apertures, with the receptacle being periodically removed for disposing of the collected shavings.

If one or both of the cutting edges 28 and 29 of the razor blade 24 become worn, the cover 3 may be readily removed by withdrawing the screw 40. Such cover removal exposes the worn blade 24 to permit replacement or reversal of the same for subsequent encasement by cover 3. This arrangement of the cover, blade and housing allows easy removal and replacement of such blade and prolongs the useful life of the hand-held pencil sharpener disclosed herein.

We, therefore, particularly point out and distinctly claim as our invention:

1. A hand-held pencil sharpener comprising a housing having both a top recess therein to define an enclosed slightly lowered seating surface and a tapered bore therein selectively to receive a pencil for sharpening, said bore tangentially intersecting the seating surface of the housing at its inner end relative to the housing to form an elongated narrow slot therein, a double-edged razor blade received on said seating surface, with one edge of said blade being positioned in said slot to form a pencil shaving edge and with the ends of said blade being contained in said recess, a cover positioned on top of said housing and coextensive therewith having a projection telescopically received in said recess with the bottom wall of such projection engaging and enclosing said blade, said cover having an elongated slot therein positioned to be in alignment with the elongated slot in the seating surface upon assembly, and means releasably to secure the cover, razor blade and housing together and to prevent relative movement therebetween, whereby the tapered bore guides a pencil inserted therein against the tangentially disposed shaving edge to permit said pencil upon rotation to be sharpened thereby, with the pencil shavings passing through said aligned slots in said housing and cover for removal therefrom.

2. The pencil sharpener of claim 1 wherein at least two generally parallel tapered bores of different size are provided in said housing to receive pencils of varying sizes for sharpening, with said bores tangentially intersecting said seating surface to form narrow slots therein.

3. The pencil sharpener of claim 2 wherein said blade is positioned between said seating surface slots so that the cutting edges thereof extend into and along said slots to form pencil sharpening edges, and wherein said cover is provided with at least two parallel slots vertically aligned with the seating surface slots upon assembly.

4. The pencil sharpener of claim 1 wherein the means to secure includes two locating studs projecting upwardly from the seating surface in the recess of said housing, said studs being spaced and dimensioned respectively to be received in and extend through the spaced circular sections of the double-edged razor blade slot.

5. The pencil sharpener of claim 4 wherein the portions of the locating studs extending through said razor blade slot are received in similarly spaced and oriented sockets in the bottom wall of the projection on said cover, thereby to preclude relative rotation between the housing, razor blade and cover.

6. The pencil sharpener of claim 5 wherein the means to secure further includes a fastener passing through the cover, the central hole in the razor blade slot, and the housing to secure the same together.

7. The pencil sharpener of claim 6 wherein the fastener is centrally positioned relative to the sharpener and is between said locating studs, the head of the fastener being received in a countersunk bore in the cover and the leading end of the fastener shank being threadably engaged with threads in the housing.

8. The pencil sharpener of claim 6 wherein the ends of the recess have the same general configuration as the ends of the razor blade.

* * * * *